US009828709B2

(12) United States Patent
Oda et al.

(10) Patent No.: US 9,828,709 B2
(45) Date of Patent: Nov. 28, 2017

(54) PATTERN-DATA CREATING PROGRAM FOR BORDER PATTERN AND SEWING MACHINE

(71) Applicant: JANOME SEWING MACHINE CO., LTD., Hachioji-shi, Tokyo (JP)

(72) Inventors: Hiromi Oda, Hachioji (JP); Hayato Takada, Hachioji (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 245 days.

(21) Appl. No.: 14/732,011

(22) Filed: Jun. 5, 2015

(65) Prior Publication Data

US 2016/0160414 A1 Jun. 9, 2016

(30) Foreign Application Priority Data

Dec. 7, 2014 (JP) ..... 2014-247510

(51) Int. Cl.
*D05B 21/00* (2006.01)
*D05B 19/08* (2006.01)
*D05B 19/12* (2006.01)

(52) U.S. Cl.
CPC ..... *D05B 19/08* (2013.01); *D05B 19/12* (2013.01); *D05B 21/00* (2013.01)

(58) Field of Classification Search
CPC .. D05B 21/00; D05B 2207/04; D05B 21/005; A41G 9/00
USPC ..... 2/470.07, 470.05, 470.11, 475.19
See application file for complete search history.

(56) References Cited

U.S. PATENT DOCUMENTS 5,553,559 A * 9/1996 Inoue ..... D05B 19/085 112/102.5
5,865,133 A * 2/1999 Herbach ..... D05B 21/800 112/102.5
8,527,083 B2 * 9/2013 Tokura ..... D05B 19/10 112/102.5
8,607,721 B2 * 12/2013 Koga ..... D05B 19/12 112/475.05
2007/0206371 A1 * 9/2007 Yamasaki ..... D05B 19/12 362/90

FOREIGN PATENT DOCUMENTS

JP 2009219596 A 10/2009

* cited by examiner

*Primary Examiner* — Tejash Patel
(74) *Attorney, Agent, or Firm* — Nath, Goldberg & Meyer; Jerald L. Meyer

(57) ABSTRACT

A sewing machine includes a display which displays a pattern and a marking. A marking-data disposing position specifier specifies the disposing position of another pattern relative to the pattern. A marked pattern replicator displays, on the display, plural marked patterns that are the patterns on which the corresponding markings are disposed. The positions where the plural marked patterns are displayed are set based on the markings of the plural marked patterns. After the display positions of the plural marked patterns are set, the marking of the marked pattern is deleted. Accordingly, pattern data of a new pattern is created.

8 Claims, 14 Drawing Sheets

REFERENCE POSITION

WHEN SPAN BETWEEN PATTERNS IS INCREASED

WHEN SPAN BETWEEN PATTERNS IS REDUCED

PATTERN-DATA CREATING PROGRAM FOR BORDER PATTERN AND SEWING MACHINE

CROSS-REFERENCE TO RELATED APPLICATIONS

This application is based upon and claims the benefit of priority from Japan Patent Application No. 2014-247510, filed on Dec. 7, 2014, the entire contents of which are incorporated herein by reference.

FIELD OF THE INVENTION

The present invention relates to a program that creates pattern data of a border pattern, and a sewing machine which utilizes that program.

BACKGROUND

Conventional sewing machines that can perform stitchwork stitches a pattern based on pattern data for stitching that is given to the sewing machines. When, for example, the sewing machines sew a sequential pattern that is so-called a border pattern, first, a pattern is sewn, and a next pattern adjoining to the already sewn pattern is sewn, and this process is repeated by plural times. A stitchwork frame that holds a cloth is necessary to sew a stitch. When a larger pattern than the stitchwork frame is to be sewn, it is necessary for a user to remove the stitchwork frame from a position where the stitchwork to the cloth is completed, and to attach the stitchwork frame to an adjoining position where the stitchwork is not completed yet.

In order to sew a new pattern adjoining to the already stitched pattern so as to forma sequential pattern in a single shape, it is necessary to adjust the stitchwork start position after the stitchwork frame is attached to the new position. When, however, the stitchwork start position is adjusted based on the feeling of the user only, the position of the new pattern adjoining to the already stitched pattern sometimes misaligned.

According to conventional stitchwork technologies, in order to precisely adjust the stitchwork start position, pattern data contains positioning data. In addition, a positioning marking is sewn together with the pattern, enabling the start of sewing of the adjoining pattern with reference to that marking. A technology that assists the positioning of a pattern is conventionally known (see, for example, JP2009-219596 A).

When pattern data contains positioning data, the positioning data is disposed at the four corners of the outer circumference of the pattern data. Hence, in any directions from side to side and up and down, a new pattern can be positioned and disposed. When a pattern that contains this positioning data is sewn, positioning markings are sewn at the four corners of the pattern. When a new pattern is to be sewn at the right side of the already sewn pattern, the adjoining pattern is positioned with reference to the two markings at the right side. That is, the markings sewn at the left side of the pattern are not utilized.

In addition, when, for example, the same three patterns can be arranged in the stitchwork frame, and those six patterns are sewn in sequence, a replacement work of the stitchwork frame is once necessary. According to the conventional technologies, since the markings are provided at the four corners of each pattern, the respective three patterns within the stitchwork frame have the respective positioning markings. Hence, markings that are unnecessary for positioning of the pattern are sewn to the cloth, resulting in unnecessary needle locations at the time of stitching. Consequently, it is necessary for the user to remove a large number of markings after the completion of sewing.

The present invention has been made to address the above-explained problems of the conventional technologies, and it is an objective of the present invention to provide a program that can create pattern data of a border pattern which has a positioning marking disposed at an arbitrary location, and a sewing machine which utilizes that program.

SUMMARY OF THE INVENTION

To accomplish the above objective, a sewing machine according to an aspect of the present invention is capable of creating a new pattern, and includes: a display; a pattern-data memory storing stitchwork data for sewing a pattern that will be a reference for the new pattern, and image data for displaying the pattern on the display; a pattern display controller displaying the pattern on the display based on the image data of the pattern; a marking-data memory storing stitchwork data for sewing a marking to be combined with the pattern, and image data for displaying the marking on the display; a marking display controller displaying the marking on the display based on the image of the marking; a marking disposing position specifier specifying a display position of the marking relative to the pattern; a marked pattern replicator replicating a marked pattern that is the pattern having the marking displayed at a marking disposing position of the pattern; a display controller displaying the marked pattern in such a way that the marking of the original marked pattern and the marking of the replicated marked pattern are arranged so as to overlap with each other; and a marking deleter deleting the marking of the plurality of marked patterns on the display controller.

The new pattern may include the plurality of the patterns arranged side by side in an arbitrary direction, the sewing machine may further include a pattern-sequential-direction specifier specifying the direction in which the plurality of patterns are arranged in sequence, and the marking displayed relative to the pattern may be changed in accordance with the pattern sequential direction.

The display position of the marking may be set with reference to four corners of the pattern.

The sewing machine may further include a marking-data disposing position specifier changing the display position of the marking, in which the display positions of the two markings in the pattern sequential direction among the plurality of display positions may be moved along the pattern sequential direction.

The marking deleter may hide the deletion target marking, thereby deleting the marking on the display.

The pattern and the marking may be divided and displayed in different layers on the display.

The sewing machine may create, based on stitchwork data corresponding to the image data of the pattern and the image data of the marking in which the pattern and the marking form the new pattern, stitchwork data of the new pattern displayed on the display.

According to another aspect of the present invention, there is provided a computer-readable non-transitory recording medium having stored a pattern-data creating program for a computer, in which the computer includes: a pattern-data memory storing stitchwork data for sewing a pattern, and image data for displaying the pattern on a display; and a marking-data memory storing stitchwork data for sewing a marking to be combined with the pattern, and image data for displaying the marking on the display, and the computer controls the display displaying the pattern and the marking, and in which the pattern-data creating program causes the computer to execute: a pattern displaying process of displaying the pattern on the display based on the image data of the pattern; a marking disposing position specifying process of specifying a disposing position of the marking relative to the pattern displayed on the display; a marking displaying process of displaying the marking on the display based on the image data of the marking; a marked pattern replicating process of replicating a marked pattern having the marking displayed at a marking disposing position of the pattern; a marked pattern displaying process of displaying the marked pattern in such a way that the marking of the original marked pattern and the marking of the replicated marked pattern are arranged so as to overlap with each other; and a marking deleting process of deleting the marking of the plurality of marked patterns on the display.

According to the present invention, by disposing the marking data at an arbitrary position of the pattern data, it becomes possible to sew a border pattern through a simple procedure without sewing an unnecessary marking.

DETAILED DESCRIPTION OF THE EMBODIMENTS

1. First Embodiment

[1-1. Structure]

(1. General Structure)

Figure 1:
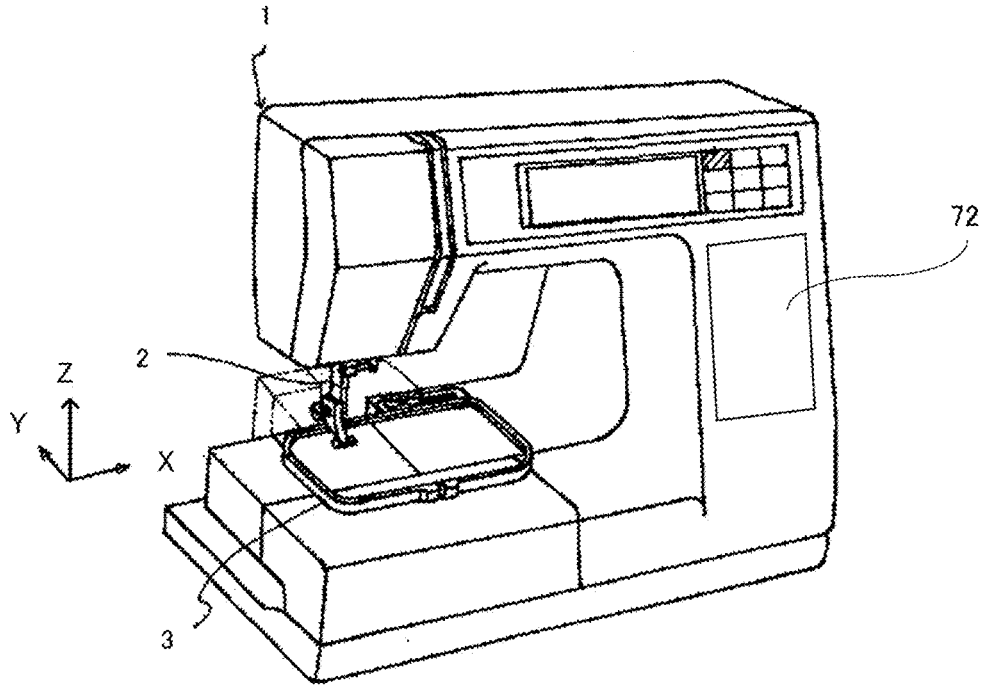
FIG. 1 is a perspective view illustrating a sewing machine entirely according to a first embodiment.

FIG. 1 is a perspective view illustrating a sewing machine according to this embodiment. It is defined in FIG. 1 that a cloth feeding direction is a Y direction, an orthogonal direction to the cloth feeding direction is an X direction, and a vertical direction is a Z direction. As illustrated in FIG. 1, a sewing machine 1 includes a needle bar 2. The needle bar 2 supports a needle into which a needle thread is inserted. The needle thread is supplied to the needle from a thread supply source. An unillustrated hook that retains therein a bobbin around which a bobbin thread is wound is disposed below the needle bar 2 in the sewing machine 1. The hook catches, by a tip thereof, the needle thread that has passed through a cloth by the needle. The needle bar 2 and the hook are driven by drive force from a sewing machine motor 61.

A stitchwork frame 3 is fastening member for the cloth that applies tension thereto. The stitchwork frame 3 is horizontally movable in the cloth feeding direction (Y direction in FIG. 1) and the orthogonal direction (X direction in FIG. 1) to the cloth feeding direction. The stitchwork frame 3 is driven by drive force from an X/Y motor 62.

Figure 2:
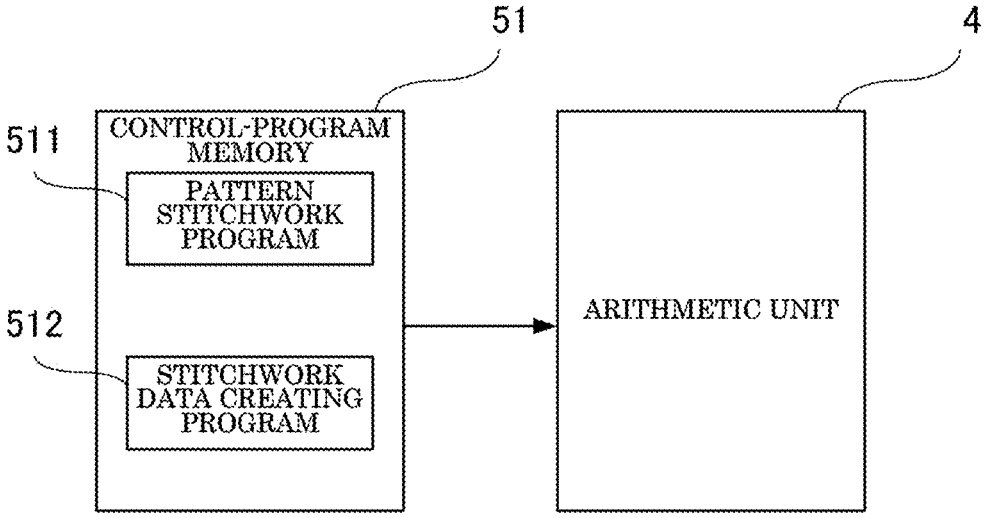
FIG. 2 is a block diagram illustrating a relationship between a program memory and an arithmetic unit both in the sewing machine of the first embodiment.

The sewing machine 1 is a computerized sewing machine. The term computerized sewing machine means a sewing machine that controls each unit in accordance with a control program. As illustrated in FIGS. 1 and 2, the sewing machine 1 includes a control-program memory 51 and an arithmetic unit 4.

The control-program memory 51 stores a pattern stitchwork program 511, and a pattern-data creating program 512. The pattern stitchwork program 511 is to stitch a pattern. The pattern stitchwork program 511 is described with the following processes:

(a) Pattern-data reading process;

(b) Sewing-machine control process; and (c) X/Y-motor control process.

The pattern-data creating program 512 is to create pattern data. The pattern-data creating program 512 is described with the following processes to create the pattern data:

(a) Pattern-data reading process;

(b) Pattern-shape displaying process;

(c) Editorial-dialogue reading process;

(d) Editorial-dialogue displaying process;

(e) Marking-data reading process;

(f) Marking displaying process;

(g) Pattern-data converting process; and (h) Pattern-data storing process.

The arithmetic unit 4 is a so-called CPU. The arithmetic unit 4 controls each unit of the sewing machine in accordance with the pattern stitchwork program 511 and the pattern-data creating program 512, thereby serving as a control unit 8 to be discussed later.

(2. Structure)

Figure 3:
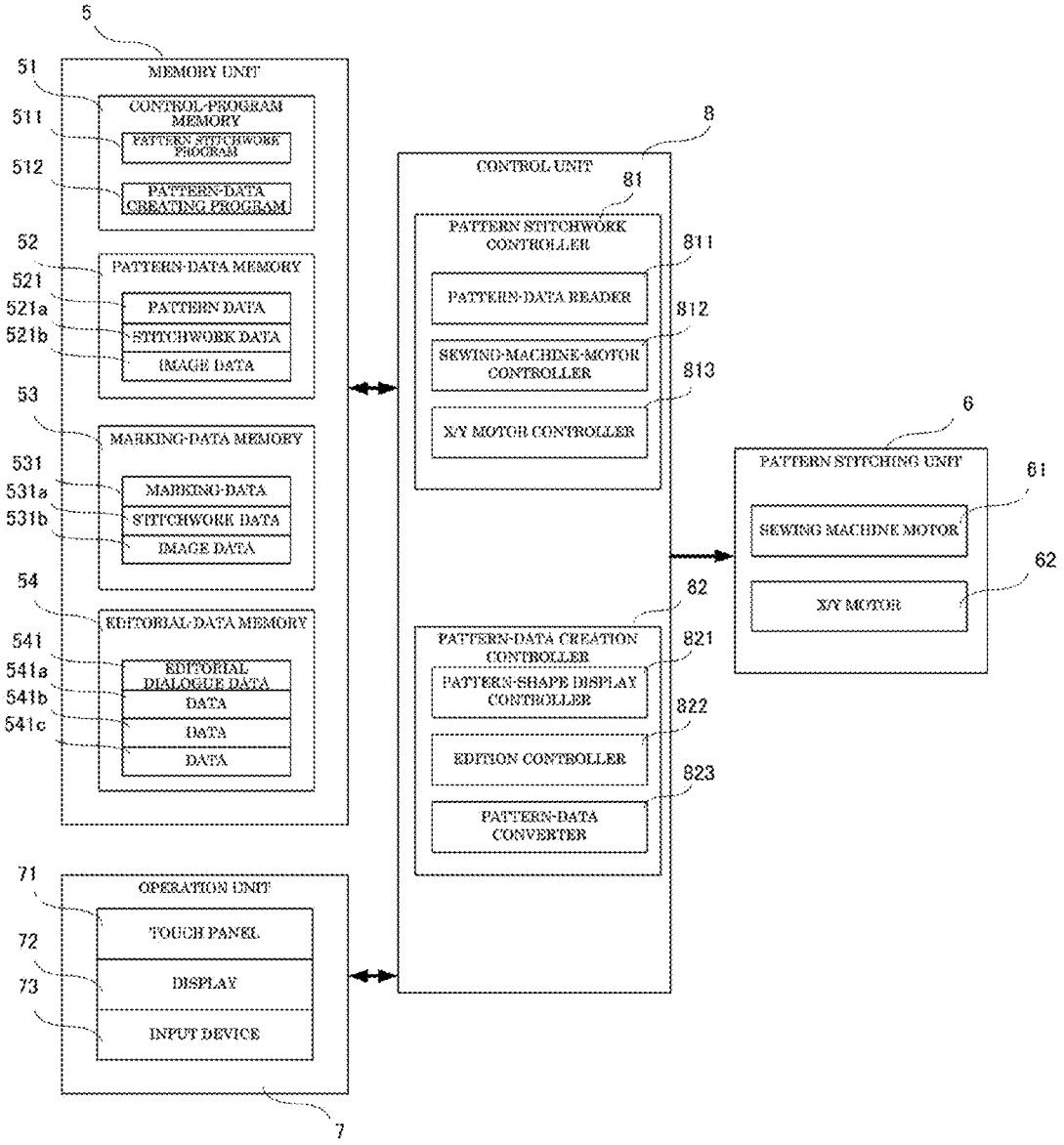
FIG. 3 is a block diagram illustrating a structure of a control unit according to the first embodiment.

FIG. 3 is a structural diagram of the sewing machine 1. The sewing machine 1 includes a memory unit 5, a pattern stitching unit 6, an operation unit 7, and the control unit 8.

The memory unit 5 is, for example, an HDD. The memory unit 5 includes the control-program memory 51, a pattern-data memory 52, a marking-data memory 53, and an editorial-data memory 54.

The pattern-data memory 52 stores pattern data 521. The pattern data 521 contains stitchwork data 521*a*, and image data 521*b*. The stitchwork data 521*a* employs a data structure in which positioning data, a color change command, and stitch data are associated with a number of stitches.

The positioning data represents coordinates to form a stitch. The color change command instructs a timing at which the thread is changed. The stitch data specifies the amount of displacement of the stitchwork frame 3 in the X and Y directions, and the stitch balancing thread tension of the thread at the time of stitching. The image data 521*b* is utilized to display the pattern data on a display device 72. The image data 521*b* represents, for example, the finishing of a stitched pattern based on the pattern data.

The marking-data memory 53 stores marking data 531. The marking data 531 contains, like the pattern data 521, stitchwork data 531*a*, and image data 531*b* utilized to display the marking data on the display device 72.

The editorial-data memory 54 stores editorial dialogue data 541. The editorial-data memory 54 stores the following pieces of data:

(a) Data 541*a* on the editorial dialogue utilized to specify a direction in which patterns are arranged in sequence;

(b) Data 541*b* on the editorial dialogue utilized to adjust the position of the marking data added to the pattern data; and (c) Data 541*c* on the editorial dialogue utilized to delete the marking data.

The pattern stitching unit 6 includes the sewing machine motor 61 and the X/Y motor 62. The sewing machine motor 61 generates the drive force that swings the needle bar 2 up and down, and the drive force that rotates the hook. The X/Y motor 62 generates the drive force that moves the stitchwork frame 3 in the X and Y directions.

The operation unit 7 includes a touch panel 71. The touch panel 71 is disposed on a surface of the sewing machine 1. The touch panel 71 includes the display device 72 and an input device 73. The display device 72 displays images based on data for image display. The input device 73 outputs the coordinate data on the display device 72 at which a finger, a touch pen, etc., touches.

The control unit 8 includes a pattern stitchwork controller 81 and a pattern-data creation controller 82.

(1-1) Structure of Pattern Stitchwork Controller 81

The pattern stitchwork controller 81 controls each unit of the sewing machine 1 in accordance with the pattern stitchwork program 511. The pattern stitchwork controller 81 includes the following structures:

(a) Pattern-data reader 811;

(b) Sewing-machine-motor controller 812; and (c) X/Y motor controller 813.

The pattern-data reader 811 reads the pattern data 521 from the pattern-data memory 52. The sewing-machine-motor controller 812 outputs control signals to the sewing machine motor 61 in accordance with the pattern data 521. The X/Y motor controller 813 outputs control signals to the X/Y motor 62 in accordance with the pattern data 521.

(1-2) Function of Pattern Stitchwork Controller 81

Figure 4:
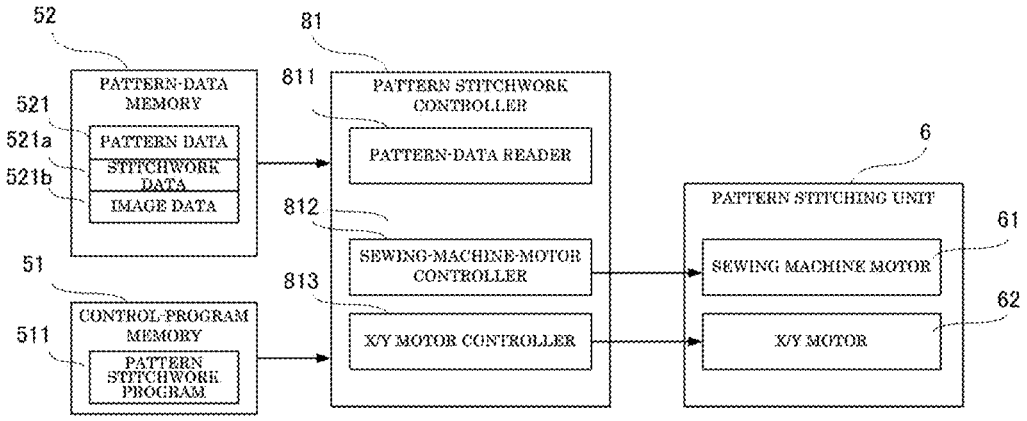
FIG. 4 is a functional block diagram illustrating a function of a pattern stitchwork controller according to the first embodiment.

FIG. 4 is a functional block diagram illustrating an operation of the pattern stitchwork controller 81. As illustrated in FIG. 4, the pattern-data reader 811 reads the pattern data 521 from the pattern-data memory 52. The sewing-machine-motor controller 812 extracts the stitchwork data 521*a* from the pattern data 521. Next, the sewing-machine-motor controller 812 outputs control signals to the sewing machine motor 61 based on the stitchwork data 521*a*. The sewing machine motor 61 operates in accordance with the input control signals. Likewise, the X/Y motor controller 813 controls the X/Y motor based on the stitchwork data 521*a*.

(2-1) Structure of Pattern-Data Creation Controller 82

The pattern-data creation controller 82 creates the pattern data of a new pattern in accordance with the pattern-data creating program 512. The pattern-data creation controller 82 includes the following structures as illustrated in FIG. 3:

(a) Pattern-shape display controller 821;

(b) Edition controller 822; and (c) Pattern-data converter 823.

Figure 5A:
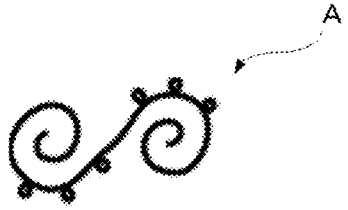
FIGS. 5A to 5E are diagrams illustrating a pattern A, a marking B, a marked pattern C, a pattern D for creating a border, and a border pattern E all displayed on a display device of the first embodiment.
Figure 5B:
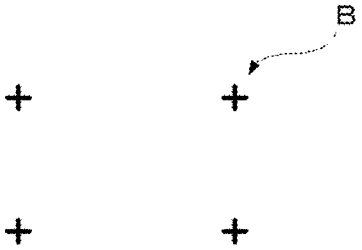
Figure 5C:
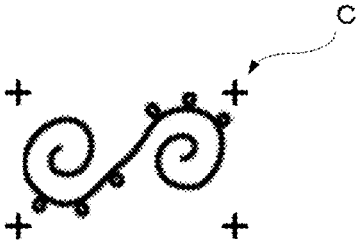

The pattern-shape display controller 821 reads the pattern data 521 from the pattern-data memory 52. Next, the pattern-shape display controller 821 extracts the image data 521*b* from the read pattern data 521. As illustrated in FIGS. 5A to 5C, the pattern-shape display controller 821 displays a pattern A on the display device 72 based on the image data 521*b*. In addition, the pattern-shape display controller 821 reads the marking data 531 from the marking-data memory 53. Next, the pattern-shape display controller 821 extracts the image data 531*b* from the read marking data 531. The pattern-shape display controller 821 displays, based on the image data 531*b*, a marking B on the display device 72 with reference to the four corners of the pattern A. That is, the display device 72 simultaneously displays the pattern A and the marking B.

In this case, the pattern-shape display controller 821 may divide and display the pattern A and the marking B in different layers. Accordingly, it becomes possible for the user to move, delete, etc., the marking to be discussed later by moving, deleting, etc., the layer that displays the target marking.

The edition controller 822 reads the editorial dialogue data 541 from the editorial-data memory 54, and displays, on the display device 72, the editorial dialogue corresponding to piece of data 541*a* to 541*c* contained in the editorial dialogue data 541.

The pattern-data converter 823 converts, to stitchwork data 522*a*, image data 522*b* representing the pattern E displayed on the display device 72.

(a) Pattern-Shape Display Controller 821

Figure 7:
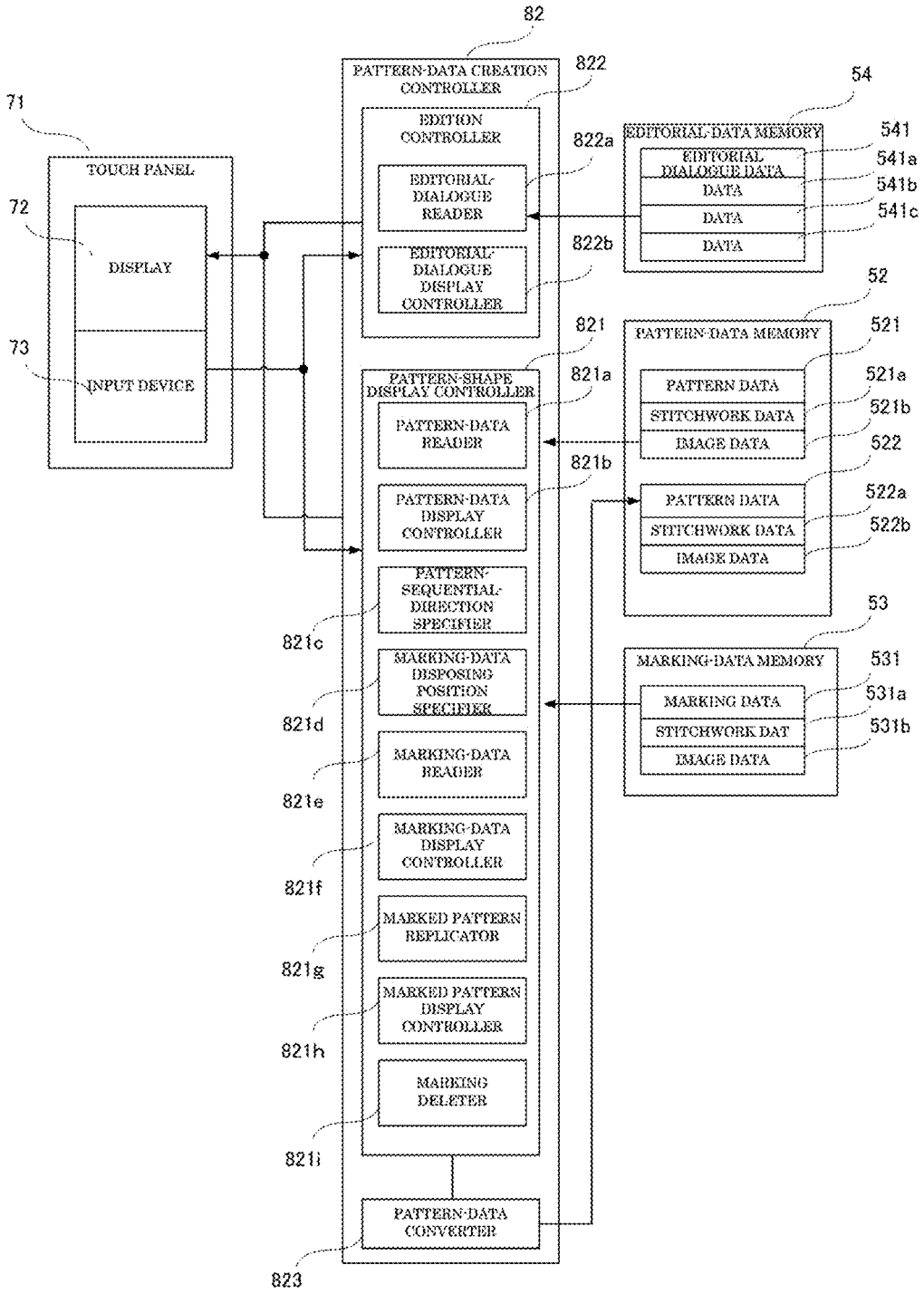
FIG. 7 is a functional block diagram illustrating a function of a pattern data creating unit according to the first embodiment.

As illustrated in FIG. 7, the pattern-shape display controller 821 includes a pattern-data reader 821*a*, a pattern-data display controller 821*b*, a pattern-sequential-direction specifier 821*c*, a marking-data disposing position specifier 821*d*, a marking-data reader 821*e*, a marking-data display controller 821*f*, a marked pattern replicator 821*g*, a marked pattern display controller 821*h*, and a marking deleter 821*i*.

The pattern-data reader 821*a* reads the pattern data 521 from the pattern-data memory 52. The pattern-data display controller 821*b* extracts the image data 521*b* from the pattern data 521. The pattern-data display controller 821*b* displays the pattern A on the display device 72 based on the image data 521*b*.

The pattern-sequential-direction specifier 821*c* specifies the sequential direction of the patterns. When the patterns A are arranged in sequence from side to side, "side to side" is specified, and when the patterns A are arranged in sequence up and down, "up and down" is specified. In addition, when a pattern A is arranged in the vertical direction and another pattern A is arranged in the lateral direction, "corner" is specified, when the patterns A are overlapped to form an upper circular arc, "upper circular arc" is specified, and when to form a lower circular arc, "lower circular arc" is specified.

The marking-data disposing position specifier 821*d* specifies the position where the marking B is disposed relative to the pattern A on the display device 72. As explained above, as to the disposing position of the marking B, the four corners of the pattern A are specified in advance as the reference positions. The marking-data disposing position specifier 821*c* changes the disposing position of the marking B to the position in accordance with an input given by the user from the reference position specified in advance.

The marking-data reader 821*e* reads the marking data 531 from the marking-data memory 53. The marking data 531 contains the stitchwork data 531*a*, and the image data 531*b* for the display on the display device 72 (see FIG. 8).

The marking-data display controller 821*f* extracts the image data 531*b* from the marking data 531. The marking-data display controller 821*f* displays the marking B at the position specified by the marking-data disposing position specifier 821*d*.

The marked pattern replicator 821*g* replicates a marked pattern C that is the pattern A on which the marking B is disposed. That is, a marked pattern C1 is replicated from the marked pattern C. Replicated data is generated by replicating the image data 521*b* of the pattern A and the image data 531*b* of the marking 531*b*.

The marked pattern display controller 821*h* displays the marked pattern C1 on the display device 72 based on the replicated image data 521*b* of the pattern A and the replicated image data 531*b* of the marking B. The display position of the marked pattern C1 is a location where the marking of the marked pattern C and the marking of the marked pattern C1 overlap. Hence, the original marked pattern C and the replicated marked pattern C1 are arranged side by side and displayed on the display device 72.

The marking deleter 821*i* deletes the marking B of the marked pattern C or of the marked pattern C1 both displayed on the display device 72. The deletion target marking B is the marking displayed at the location not utilized to stitch the border pattern. As to the way of deletion, for example, the user may select the deletion target, or the deletion target may be determined based on a predetermined rule to delete the target.

(b) Edition Controller 822

The edition controller 822 includes an editorial-dialogue reader 822*a*, and an editorial-dialogue display controller 822*b*. The editorial-dialogue reader 822*a* receives a coordinate signal that is output by the input device 73 of the touch panel 71. The editorial-dialoguer reader 822*a* reads the editorial dialogue data 541 in accordance with the received coordinate signal. The edition controller 822 displays, on the display device 72, editorial dialogues 10 to 12 respectively based on the data 541*a* to 541*c* contained in the read editorial dialogue data 541.

Figure 6A:
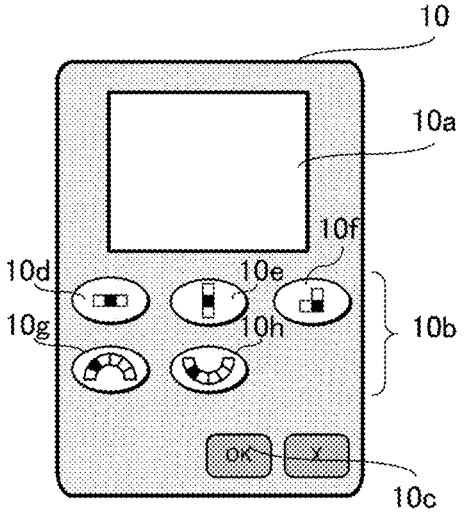
FIGS. 6A to 6C are diagrams illustrating an editorial dialogue displayed on the display device.
Figure 6B:
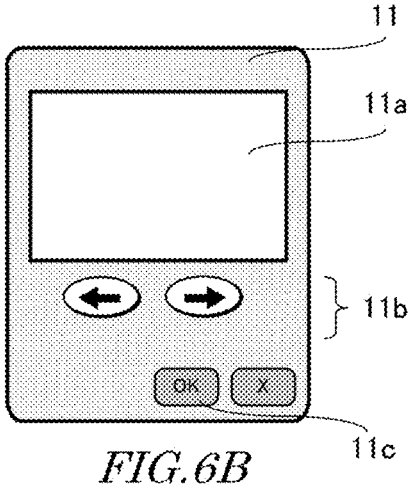
Figure 6C:
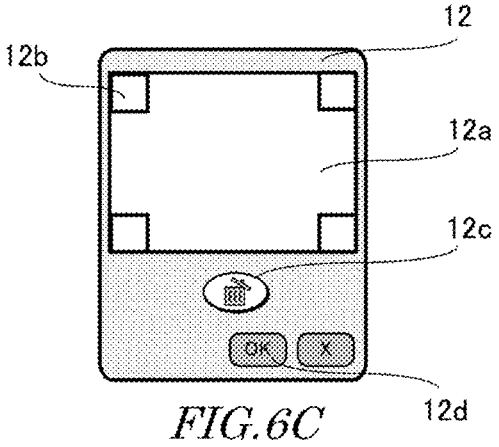

FIGS. 6A to 6C are diagrams illustrating an example editorial dialogue displayed on the display device 72. FIG. 6A illustrates the editorial dialogue 10 to select a sequential direction of the patterns. The editorial dialogue 10 includes a preview display area 10*a*, a sequential-direction specifying button 10*b*, and a process end button 10*c*. The preview display area 10*a* displays, as the sequential direction of the patterns, a positional relationship between the pattern A and an adjoining pattern A1.

The sequential-direction specifying button 10*b* is to specify the sequential direction of the patterns A. The sequential-direction specifying button 10*b* includes a button 10*d* that sets the sequential direction of the patterns A as the lateral direction, a button 10*e* that sets the sequential direction as the vertical direction, a button 10*f* that arranges a pattern in the vertical direction and also a pattern in the lateral direction as the sequential direction, a button 10*g* that sets the sequential direction as an upper circular arc, and a button 10*h* that sets the sequential direction as a lower circular arc. The process end button 10*c* fixes the sequential direction of the patterns A as the direction specified through the button 10*d* to 10*h*, and ends the process.

FIG. 6B illustrates an editorial dialogue 11 to adjust the span of the adjoining patterns A. The editorial dialogue 11 includes a preview display area 11*a*, span adjusting arrow buttons 11*b*, and a process end button 11*c*. FIG. 6C illustrates an editorial dialogue 12 to delete the marking B disposed relative to the pattern A. The editorial dialogue 12 includes a preview display area 12*a*, check boxes 12*b* to select the deletion target marking B, a deletion select button 12*c*, and a deletion execute button 12*d*.

(c) Pattern-Data Converter 823

The pattern-data converter 823 converts image data 552*a* of the pattern E created on the display device 72 to stitchwork data 552*a*. Next, the pattern-data converter 823 combines the image data 552*a* of the pattern displayed on the display device 72 with the stitchwork data 553*a* converted by the pattern-data converter 823 to create pattern data 552 of the pattern E, and stores this pattern data in the pattern-data memory 52.

(2-2) Function of Pattern-Data Creation Controller 82

FIG. 7 is a functional block diagram illustrating an operation of the pattern-data creation controller 82. The pattern-data creation controller 82 does not directly create stitchwork data 522 of a new pattern from the stitchwork data 521*a*, 531*a*. Alternatively, the pattern-data creation controller 82 combines, on the display device 72, the pattern A based on the image data 521*b* with the marking B based on the image data 531*b* as illustrated in FIGS. 5A to 5E. The combined image is defined as marked pattern data C. Next, plural pieces of marked pattern data C are arranged on the display device 72 to form a pattern D. An unnecessary marking B in the creation data D at the time of stitching is then deleted. Hence, pattern data E with a new pattern shape is created on the display device 72. Subsequently, as the stitchwork data 522 of the pattern data E, the stitchwork data 522*a* and the image data 522*b* are stored.

The pattern-shape display controller 821 receives a signal from the input device 73 of the touch panel 71. When the user selects the pattern A, the pattern A based on the image data 521*b* is displayed on the display device 72.

Figure 8:
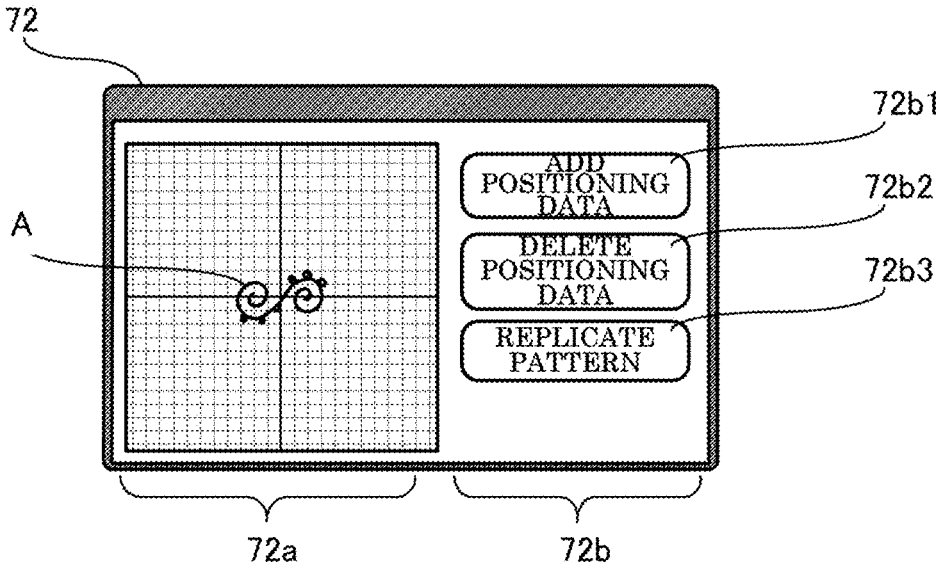
FIG. 8 is a screen structure diagram illustrating a display example of the display device that displays the pattern A.

FIG. 8 illustrates how the pattern A is displayed on the display device 72 based on the image data 521*b*. The display device 72 includes a pattern display area 72*a*, and a command display area 72*b*.

The pattern display area 72*a* displays the pattern A, the marking B, the marked pattern C, the pattern D, and the pattern data E.

The command display area 72*b* displays command buttons 72*b*1 to 72*b*3 displayed as "add positioning data", "delete positioning data", and "replicate pattern", respectively. When the user pushes the command button 72*b*1 to 72*b*3, the editorial dialogue corresponding to each command button 72*b*1 to 72*b*3 is displayed on the display device 72. The command button 72*b*1 that is "add positioning button" displays the editorial dialogue 11. The command button 72*b*2 that is "delete positioning button" displays the editorial dialogue 12.

The pattern-data converter 823 creates the stitchwork data 522*a* from the image of the new pattern E displayed on the display device 72. That is, when the new pattern E is created on the display device 72, the pattern E being displayed on the display device 72 is displayed based on the image data 522*b*. Hence, even if this image data 522*b* is read as the stitchwork data 522*a*, the stitching of the pattern E cannot be carried out. This is because the image data 522*b* does not contain positioning data, a color change command, and stitch data which are necessary to stitch the pattern E.

Therefore, the pattern-data converter 823 refers to pieces of the stitchwork data 521*a*, 531*a* of the pattern A and the marking B utilized when the image data 522*b* is created, performs modification, addition, deletion, etc., on such data to create the stitchwork data 522*a*. The stitchwork data 522*a* is stored in the stitchwork data memory 52 in association with the image data 522*b*.

In addition, the pattern-data converter 823 may determine whether the stitchwork data 522*a* is created based on the stitchwork data 521*a* of the pattern A or is created based on the stitchwork data 531*a* of the marking B. An example way of this data determination is to add a flag to either data.

[1-2. Operation]

An explanation will now be given of an operation of the sewing machine of this embodiment.

Figure 5D:
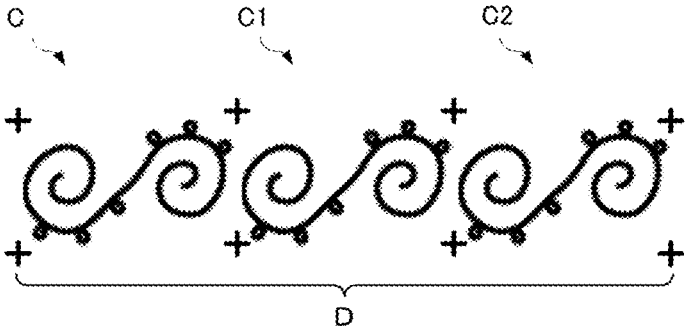
Figure 5E:
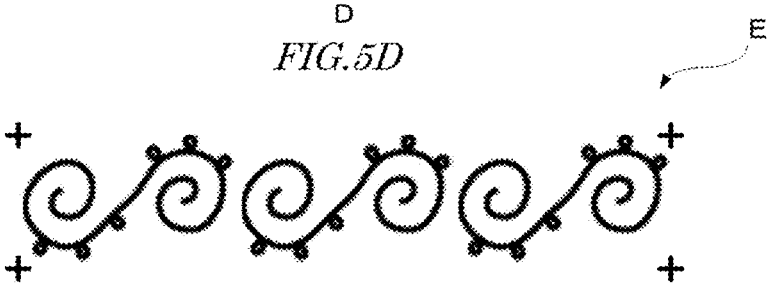

In this embodiment, in order to facilitate understanding to the present invention, it is presumed that the pattern data E that includes a new pattern shape is the pattern data to create a border pattern. That is, the pattern data E includes a shape that has the three patterns A arranged side by side. The size of the pattern E enables the pattern A to be arranged side by side within the stitchwork frame 3. The marking B is disposed at the four corners of the pattern E. FIG. 5A illustrates the pattern A displayed on the display device 72 based on the image data 521*b* of the pattern data 521. FIG. 5B illustrates the marking B displayed based on the image data 531*b* of the marking data 531. FIG. 5C illustrates the marked pattern C that has the marking B disposed at the predetermined locations of the pattern A. FIG. 5D illustrates the pattern D that has the plural marked patterns C arranged side by side. FIG. 5E illustrates the border pattern data E that has the unnecessary marking B deleted from the pattern D.

(1) Stitching Mode

In a stitching mode, the needle thread is inserted into the needle hole of the needle, the bobbin around which the bobbin thread is wound is retained in the inner hook, and the user pushes a stitching start button of the sewing machine 1. This causes the pattern stitchwork controller 81 to rotate the sewing machine motor 61 in accordance with the pattern stitchwork program 511 and a preset stitching speed. Drive force generated by the sewing machine motor 61 moves the needle bar up and down, and thus a stitch is formed.

When a pattern stitchwork is performed, the movement of the stitchwork frame 3 is controlled in accordance with the contents of the stitchwork data 521*a* of the pattern data 521 in addition to the formation of a stitch by moving the needle bar 2 up and down.

(2) Pattern Data Creating Mode

Figure 9:
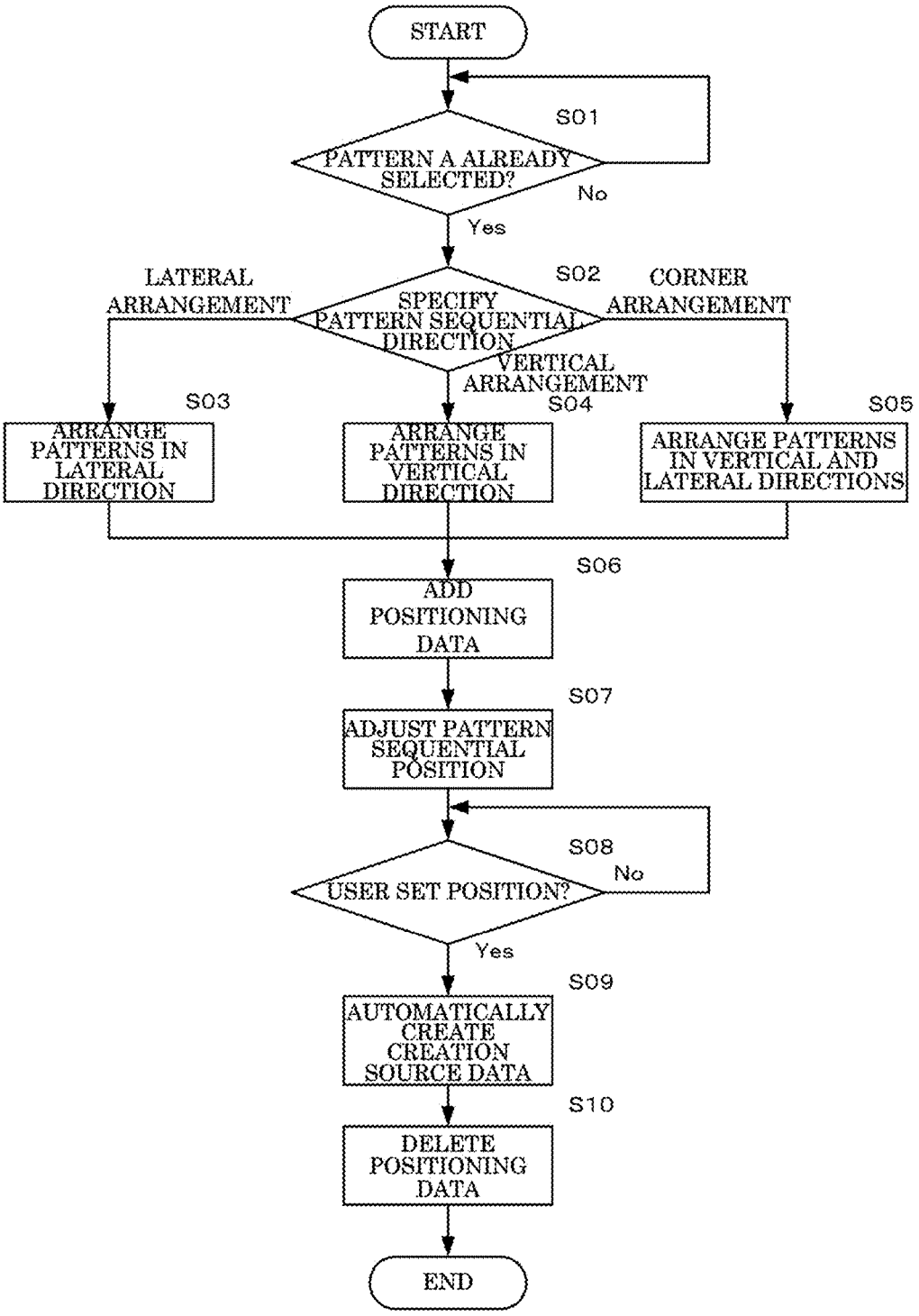
FIG. 9 is a flowchart illustrating creating procedures of a border pattern according to the first embodiment.

FIG. 9 is a flowchart illustrating sewing procedures of the pattern data 522 of the border pattern E by the sewing machine of this embodiment. In the pattern data creating mode, the sewing machine executes the following procedures to create the pattern data 522 of the border pattern E:

(a) Selection of pattern A;

(b) Specification of sequential direction of patterns A;

(c) Addition of marking B;

(d) Adjustment of disposing position of marking B;

(e) Creation of marked pattern C;

(f) Replication of marked pattern C; and (g) Deletion of unnecessary marking B.

(a) Selection of Pattern A

To create the stitchwork data of the border pattern E, the sewing machine receives (step S01) a selection of the pattern A to be sequential. That is, the user operates the sewing machine 1, and selects an arbitrary pattern among the patterns stored in the pattern-data memory 52.

It is presumed that the pattern selected by the user is the pattern A in FIG. 5A. When the user selects the pattern A, the pattern-data display controller 821*b* displays the pattern A on the display device 72 based on the image data 521*b*. FIG. 8 illustrates the display device 72 that displays, in the pattern display area 72*a*, the pattern A selected by the user.

(b) Specification of Pattern Sequential Direction

To create the border pattern E by arranging the patterns A in sequence, it is necessary to specify the direction in which the patterns A are in sequence. Hence, the pattern-sequential-direction specifier 821*c* receives the specifying operation by the user, and specifies the direction in which the patterns A are in sequence, i.e., a pattern sequential direction (step S02).

Figure 10:
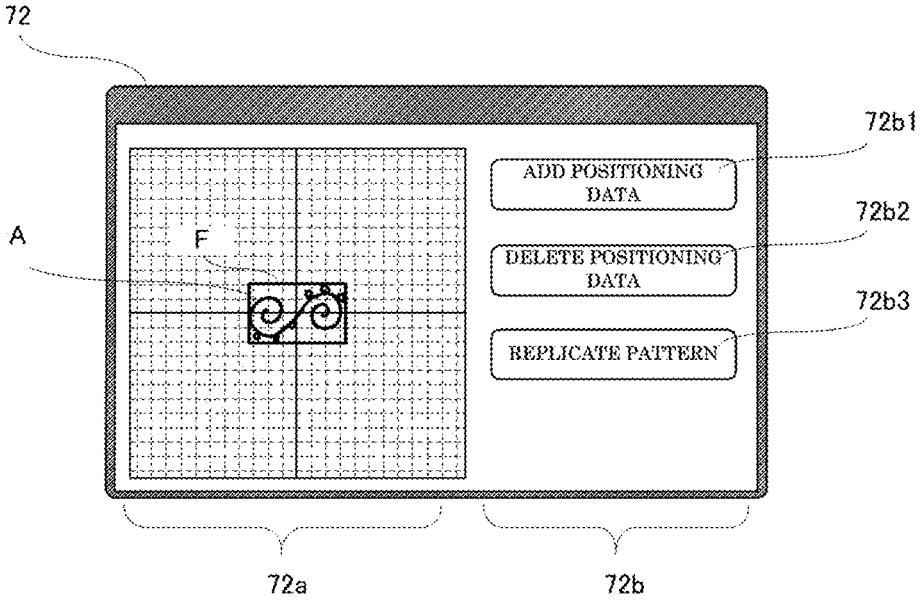
FIG. 10 is a screen structure diagram illustrating a display example of the display device that displays the pattern A and a selected frame F.

The user selects the pattern A displayed on the display device 72 to specify the sequential direction of the patterns A. The display device 72 includes the touch panel. The user touches the pattern A displayed on the display device 72, thereby selecting the pattern A. When the pattern A is selected, as illustrated in FIG. 10, the surroundings of the pattern A are surrounded by a selected frame F.

Figure 11:
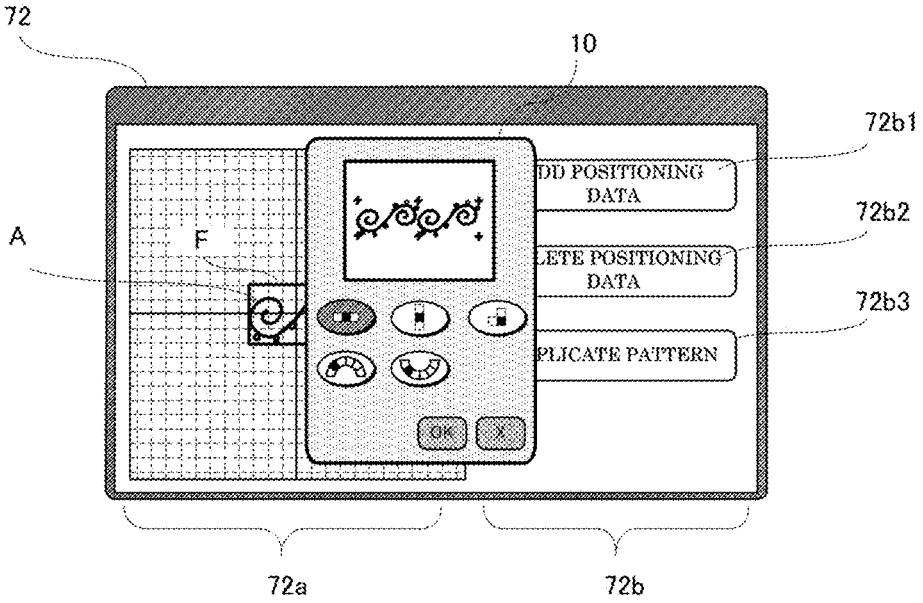
FIG. 11 is a screen structure diagram illustrating a display example of the display device that displays the editorial dialogue.

When the command button 72*b*1 that is "add positioning data" is pushed with the pattern A being selected, the editorial dialogue 10 is extracted on the display device 72 in the forefront layer, i.e., pops out. FIG. 11 illustrates the display device 72 that displays the popped-out dialogue 10.

When the patterns A are arranged in the lateral direction to form the border pattern E (lateral arrangement in S02), the button 10*d* that sets the pattern sequential direction to be the lateral direction is selected. When the plural patterns A are arranged in the vertical direction to form the border pattern E (vertical arrangement in S02), the button 10*e* that sets the pattern sequential direction to be the vertical direction is selected. When a pattern A is arranged in the vertical direction and another pattern A is arranged in the lateral direction to form the border pattern E (corner arrangement in S02), the button 10*f* that sets the pattern sequential direction to be both vertical and lateral directions is selected.

Figure 12A:
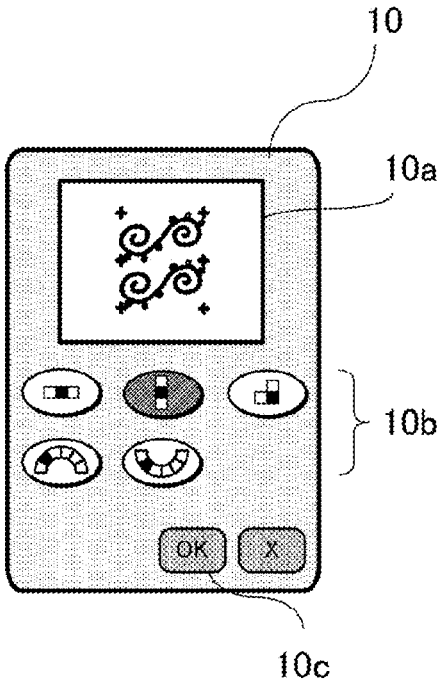
FIG. 12A and FIG. 12B are diagrams illustrating a display example of a preview screen by the editorial dialogue.
Figure 12B:
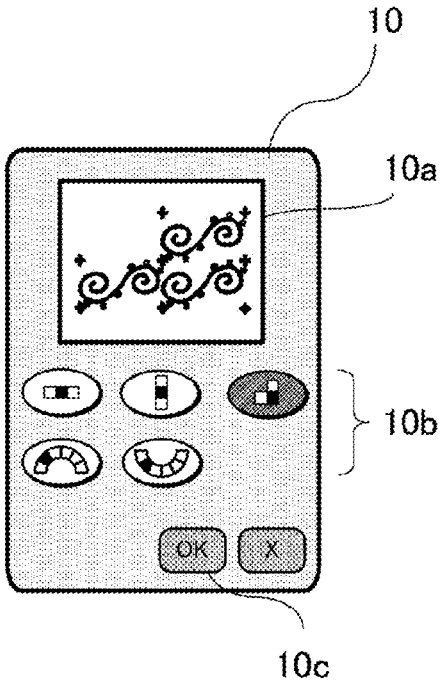

When the pattern sequential direction is specified through the button 10*d* to 10*h* that sets the pattern sequential direction, the preview display area 10*a* displays the pattern A and the adjoining pattern A1. The preview display area 10*a* in FIG. 11 displays (step S03) the pattern A and the pattern A1 when the button that sets the pattern sequential direction to be the lateral direction is selected. FIG. 12A illustrates the preview display area 10*a* when the button that sets the pattern sequential direction to be the vertical direction is selected, and as illustrated in FIG. 12A, the preview display area 10*a* displays (step S04) the pattern A and the pattern A1 when the patterns A are arranged in the vertical direction. FIG. 12B illustrates the preview display area 10*a* when the pattern sequential direction is set to be the upward direction and the leftward direction. As illustrated in FIG. 12B, the preview display area 10*a* displays (step S05) the pattern A and the pattern A1 when the patterns A are arranged so as to form a corner. The pattern sequential direction can be specified through the above-explained procedures.

(c) Addition of Marking B

When the pattern A are arranged in sequence on the display device 72, it is difficult to set the position of the adjoining pattern A1 with reference to only the pattern A. Hence, the marking B for positioning the pattern A1 is added (step S06). Accordingly, when the pattern A and the pattern A1 are arranged side by side, it becomes easy to position the adjoining pattern A1.

When the pattern sequential direction is specified, the preview display area 10*a* displays the preview when the patterns A are arranged side by side. The preview display area 10*a* displays (S06) the pattern A to which the marking B is added. That is, when the pattern sequential direction is specified, the marking-data disposing position specifier 821*d* specifies the four corners of the pattern A as the reference position of the marking disposing position. The marking-data display controller 821*f* displays, at the marking disposing position, the marking B based on the image data 531*b*.

Figure 13:
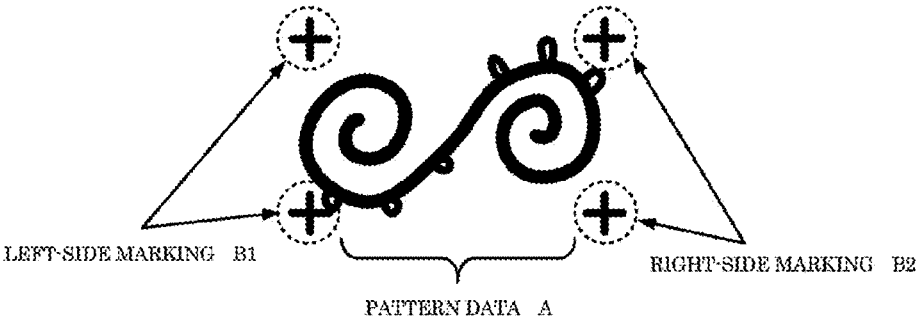
FIG. 13 is a diagram illustrating a relationship between the pattern A and the marking B when a sequence in the lateral direction is specified.

In this case, it is presumed that the marking B to be disposed is the marking B along the sequential direction of the patterns A. That is, as illustrated in FIG. 13, when the sequential direction is the lateral direction, the marking B includes left-side markings B1 and right-side markings B2. The left-side markings B1 are disposed at the upper left position of the pattern A and the lower left position thereof. The right-side markings B2 are disposed at the upper right position of the pattern A and the lower right position thereof.

(d) Adjustment of Disposing Position of Marking B

When the plural patterns A that have the marking B disposed at the reference position are arranged in sequence, the pattern A1 to be arranged next to the pattern A is disposed without a span therebetween. When the user wants to form the border pattern E that increases the span between the pattern A and the pattern A1, the disposing position of the marking B is adjusted (step S07).

As to the adjustment of the disposing position of the marking B, when the button 10*c* that sets the pattern sequential direction is pushed with the preview display area 10*a* displaying the pattern A and the pattern A1, the dialogue 10 is closed, but the new dialogue 11 is extracted and popped out. The new popped out dialogue 11 includes the preview display area 11*a* that displays a preview of a condition in which the pattern A and the pattern A1 are in sequence, and the arrow buttons 11*b* to adjust the disposing position of the marking B.

Figure 14:
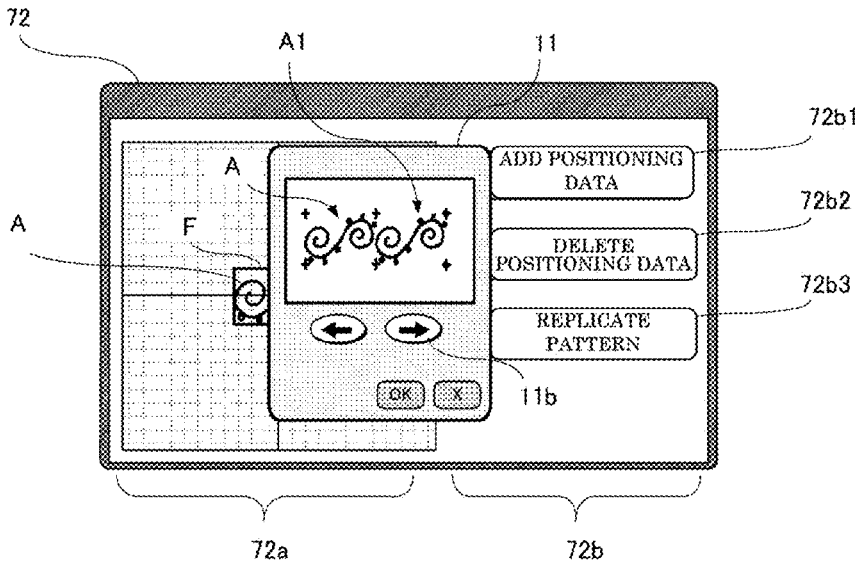
FIG. 14 is a screen structure diagram illustrating a display example of the display device that displays the editorial dialogue.

FIG. 14 illustrates the display device 72 that has the editorial dialogue 11 popped out. As illustrated in FIG. 14, the editorial dialogue 11 is displayed over the pattern display area 72*a* and the command display area 72*b*.

Figure 15:
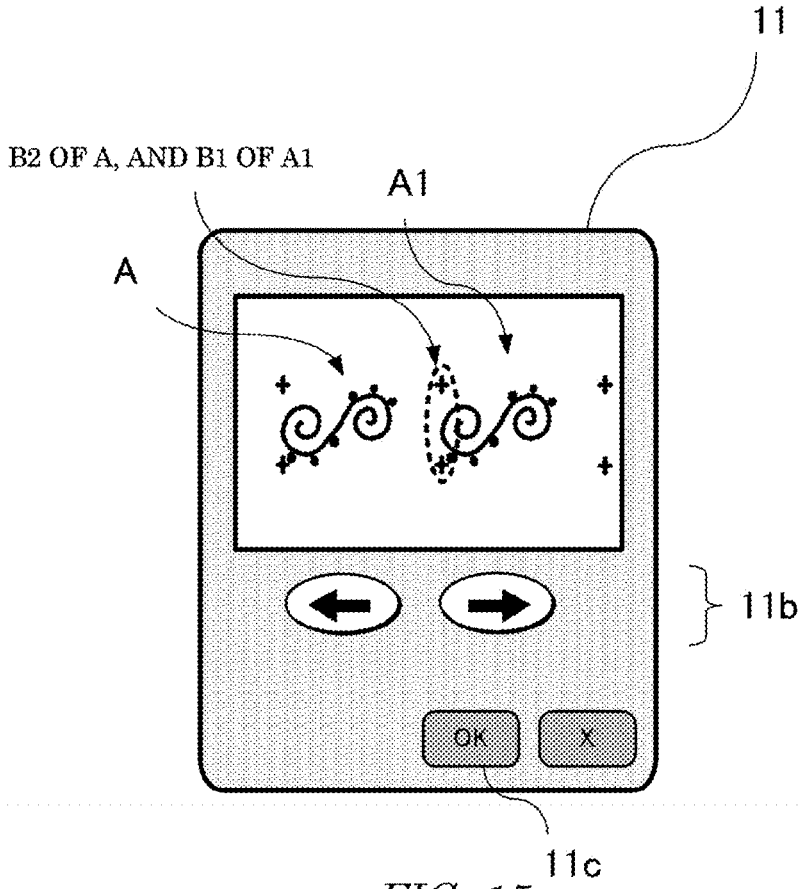
FIG. 15 is a diagram illustrating a display example of the preview screen by the editorial dialogue.

The editorial dialogue 11 in FIG. 14 includes the arrow buttons 11*b* that are right and left arrows to adjust the disposing position of the marking B. When, for example, the user wants to increase the span between the pattern A and the pattern A1 arranged at the right side, the user pushes the right arrow 11*b*. Accordingly, the positions of the right-side markings B2 disposed at the upper right position of the pattern A and the lower right position thereof are moved to the right. The pattern A1 is arranged in such a way that the moved right-side markings B2 disposed at the upper right and lower right positions of the pattern A overlap the left-side markings B1 disposed at the upper left and lower left positions of the pattern A1. Hence, the pattern A1 is arranged so as to have the span increased from the pattern A. FIG. 15 illustrates the preview display area 11*a* when the right arrow is pushed to move the positions of the right-side markings B2, and the span between the pattern A and the pattern A1 is increased. The disposing position of the marking B can be adjusted as explained above, and thus the span between the pattern A and the pattern A1 is adjustable.

(e) Creation of Marked Pattern C

Figure 16:
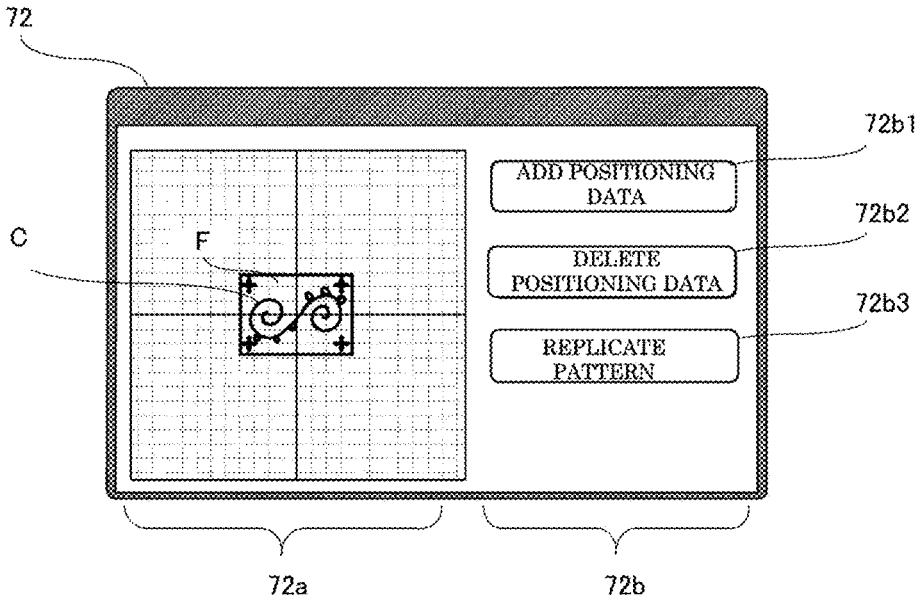
FIG. 16 is a screen structure diagram illustrating a display example of the display device that displays the pattern A and the selected frame F.

By setting the sequential direction of the patterns A and the span between the pattern A and the pattern A1, the disposing position of the marking B can be set. When the user pushes the button 11*c* to set the disposing position of the marking B, the dialogue 11 is closed. Next, as illustrated in FIG. 16, the pattern display area 72*a* of the display device 72 displays the marked pattern C that is the pattern A to which the marking B is added.

The border pattern E includes the plural patterns A arranged in sequence at an arbitrary span. Therefore, the border pattern can be created by replicating the marked pattern C, and arranging the plural marked patterns C in sequence in the specified pattern sequential direction.

After the first marked pattern C is created, the border pattern E is created by replicating this marked pattern C. To replicate the marked pattern C, the button 72*b*3 that is "replicate pattern" displayed in the command display area 72*b* is selected. When the button 72*b*3 that is "replicate pattern" is pushed, the pattern replicating process starts.

(f) Replication of Marked Pattern C

In the pattern replicating process, the marked pattern C is replicated. Next, the replicated marked pattern C1 is arranged adjacent to the marked pattern C. The arranging direction is consistent with the pattern sequential direction. When the sequential direction of the marked patterns A is the rightward direction, the marked pattern C1 is arranged relative to the marked pattern C in such a way that the right-side markings B2 of the marked pattern C overlap the left-side markings B1 of the marked pattern C1. Accordingly, the user can create the pattern D to create the border without adjusting the position of the marked pattern C and that of the marked pattern C1.

(g) Deletion of Unnecessary Marking B

Figure 17:
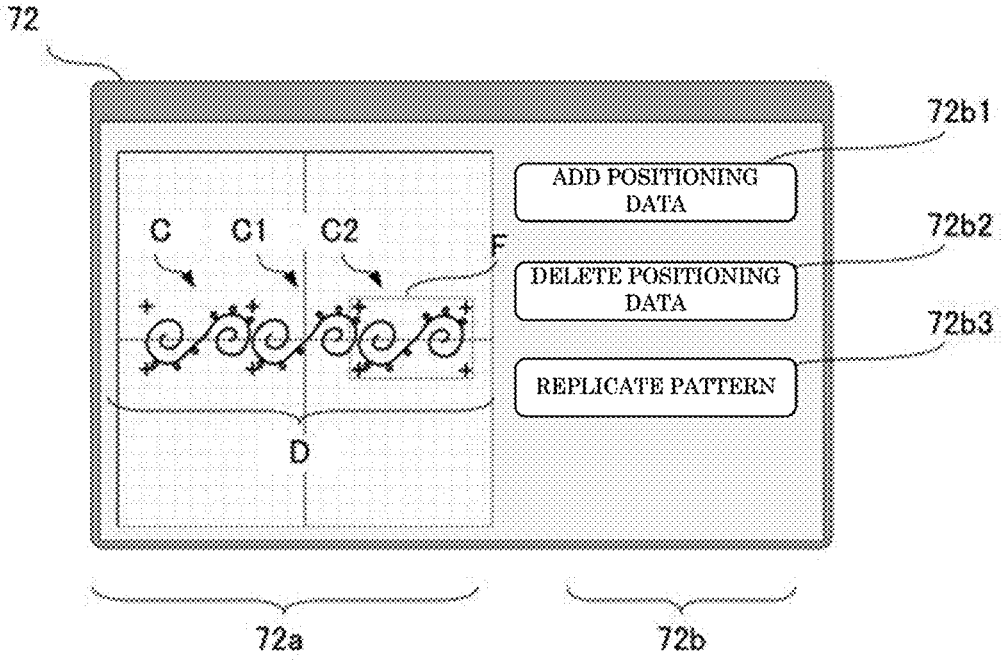
FIG. 17 is a screen structure diagram illustrating a display example of the display device that displays the pattern D for creating a border.

Next, an unnecessary marking B is deleted (step S10) from the pattern D creating the border. In FIG. 17, the marking B at the upper right and lower right positions of the marked pattern C or the marking B at the upper left and lower left positions of the marked pattern C1 is the necessary marking B when the marked pattern C1 is arranged relative to the marked pattern C. However, such a marking is not utilized when the border pattern E is sewn. Hence, after the marked pattern C, the marked pattern C1, and the marked pattern C2 are arranged, the marking B not to be utilized at the time of sewing of the border pattern is deleted.

To delete the unnecessary marking B, the marked pattern C, C1, C2 that includes the deletion target marking B is selected, and a deleting process is performed on the unnecessary marking B. The deleting process of the marking B starts when the command button 72*b*2 that is "delete positioning data" is selected.

Figure 18:
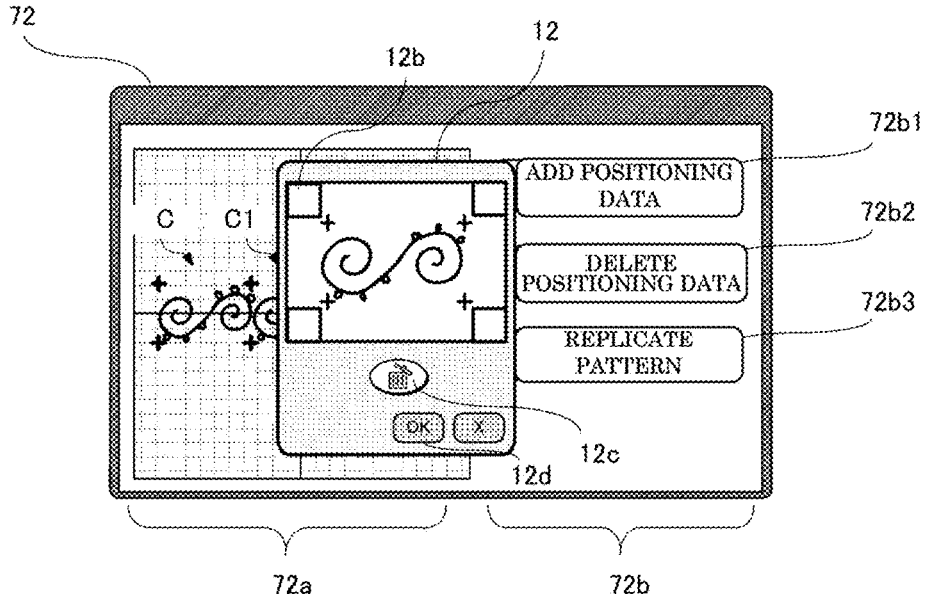
FIG. 18 is a screen structure diagram illustrating a display example of the display device that displays the editorial dialogue.

When, for example, the marking B at the upper left and lower left positions of the marked pattern C2 is to be deleted, the deleting process of the marking B is executed to the marked pattern C2. When the deleting process of the marking B starts, first, the editorial dialogue 12 pops out in the forefront layer of the display device 72. FIG. 18 illustrates the display device 72 that has the editorial dialogue 12 popped out.

Figure 19:
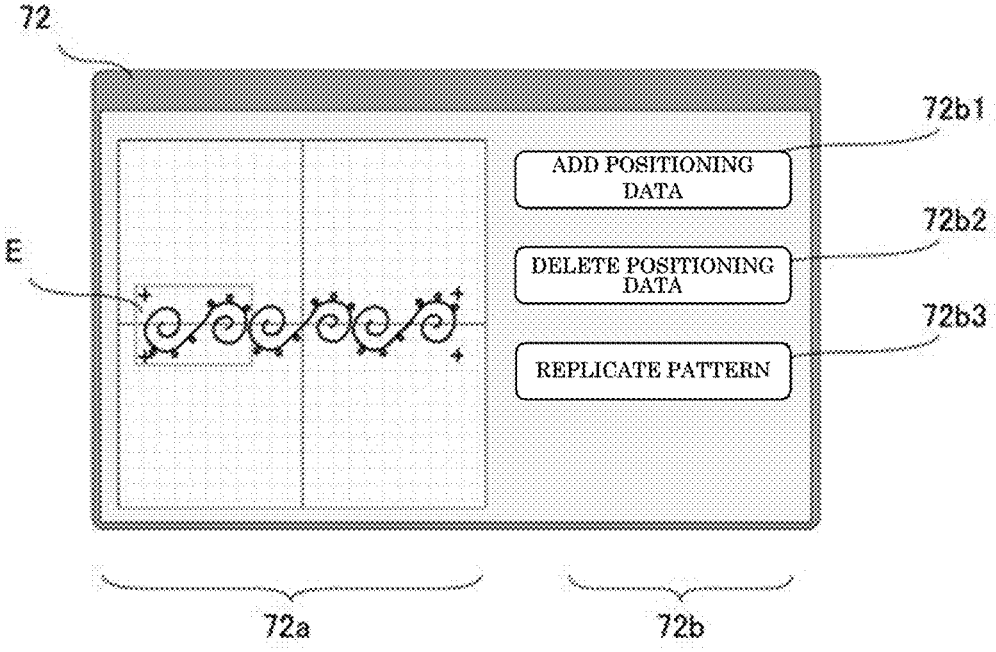
FIG. 19 is a screen structure diagram illustrating a display example of the display device that displays the border pattern E.
Figure 20A:
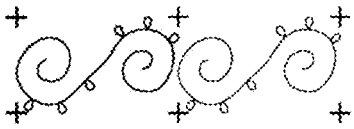
FIGS. 20A to 20C are diagrams illustrating a positional relationship between the pattern A and a pattern A1 which becomes different in accordance with the disposing position of the marking B.
Figure 20B:
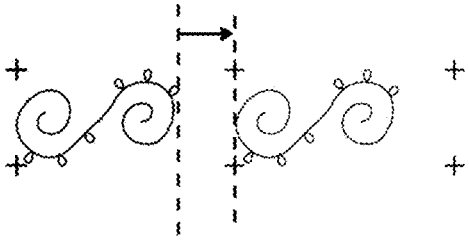
Figure 20C:
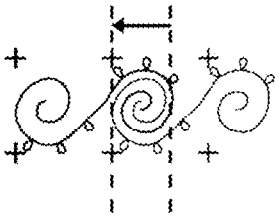

To delete the marking B at the upper left and lower left positions of the marked pattern C2, the user checks, among check boxes 12*b* displayed in the preview display area 12*a*, the upper left and lower left check boxes. Next, by selecting the deletion select button 12*c*, the marking B at the checked position can be selected as the deletion target. Subsequently, when the user pushes the deletion execute button 12*d*, the deletion target marking B at the upper left and lower left positions of the marked pattern C2 can be deleted. When this process is performed on the marking B of the marked patterns C, C1, C2, the unnecessary marking B at the time of sewing of the border pattern E can be deleted. Through the above-explained procedures, the border pattern E can be created on the display device 72. FIG. 19 illustrates the display device 72 that displays the border pattern E.

Next, the stitchwork data 522*a* is created from the image data 522*b* that represents the border pattern E displayed on the display device 72. The stitchwork data 522*a* is stored in the pattern-data memory 52 in association with the image data 522*b*.

[1-5. Effects]

The sewing machine of this embodiment as explained above can accomplish the following effects.

(1) According to the sewing machine of this embodiment, the pattern data 522 of the border pattern E that matches the size of the stitchwork frame 3 can be created from a piece of pattern data 521. Hence, when the border pattern is sewn, there is no need to sew the unnecessary marking B, and thus the unnecessary needle location can be eliminated. In addition, since there is no need to sew the unnecessary marking B, a work of removing a large number of markings B from the cloth after the completion of sewing can be eliminated.

The pattern data 522 of the border pattern can be created from the pattern data 521 and the marking data 531. Hence, it is unnecessary to store in advance the pattern data of various border patterns, and thus the necessary memory capacity can be reduced.

(2) As to the edition of the pattern data of the border pattern, the stitchwork data 521*a* of the pattern data 521 and the stitchwork data 531*a* of the marking data 531 are not directly edited. Alternatively, the pattern-data display controller that is a pattern display controller, and the marking-data display controller that is a marking display controller display the pattern A and the marking B on the display device 72. This allows the user to edit the pattern while visually checking the shape of the pattern, facilitating the user to image the pattern data of the border pattern to be created.

(3) According to this embodiment, the pattern-sequential-direction specifier 821*c* is provided. The pattern-sequential-direction specifier specifies the sequential direction of the patterns A, and the marking B is disposed in accordance with this sequential direction. That is, as illustrated in FIG. 13, when the sequential direction is the lateral direction, the marking B1 at the left side and the marking B2 at the right side are combined as a set. Hence, it is necessary for the user to specify only one marking B in the marking set when adjusting the disposing position of the marking B or when deleting the marking B.

(4) The pattern-shape display controller 821 of this embodiment divides and displays the pattern A and the marking B in the different layers. When the marking B is disposed on the display device 72 relative to the pattern A, the layer of the marking B is superimposed on the layer of the pattern A. Hence, when the position of the marking B is changed, it is unnecessary to perform a particular imaging process, and it is appropriate if the layer of the marking B is simply moved. In addition, when the marking B is deleted, it is appropriate if the layer of the marking B is simply hidden.

(5) According to this embodiment, the pattern-data converter 823 converts the image data 522*b* of the border pattern E displayed on the display device 72 to the stitchwork data 522*a*. At this time, the image data is not converted to the stitchwork data 522*a* with the marking B in the border pattern E being simply as a part of the pattern, but the image data is converted to the stitchwork data 522*a* with a flag that represents the presence of the marking B. Hence, by searching the flag of the stitchwork data 522*a*, it is possible for the user to determine whether the stitchwork data 522*a* is the stitchwork data of the border pattern or not.

2. Other Embodiments

The embodiment of the present invention was explained above, but various omissions, replacements and modifications can be made without departing from the scope of the present disclosure. The embodiment that covers such omissions, etc., and the modification thereof should be within the scope of the present invention, and also within the scope of the present invention as recited in appended claims and the equivalent range thereto.

For example, in the above-explained embodiment, the marking B was illustrated as a "+" mark, but the shape of the marking B is not limited to this shape. The shape of the marking is not limited to any particular shape as long as the position of the pattern A and that of the pattern A1 can be easily confirmed, such as "|", "-", and "x".

What is claimed is:

1. A sewing machine capable of creating a new pattern, the sewing machine comprising:

a display;

a pattern-data memory storing stitchwork data for sewing a pattern that will be a reference for the new pattern, and image data for displaying the pattern on the display;

a pattern display controller displaying the pattern on the display based on the image data of the pattern;

a marking-data memory storing stitchwork data for sewing a marking to be combined with the pattern, and image data for displaying the marking on the display;

a marking display controller displaying the marking on the display based on the image of the marking;

a pattern-sequential-direction specifier specifying the direction in which the plurality of the patterns are arranged in sequence;

a marking disposing position specifier specifying a display position of the marking relative to the pattern;

a marked pattern replicator replicating an original marked pattern that is the pattern having the marking displayed at a marking disposing position of the pattern; and a display controller displaying the marked pattern in such a way that the marking of the original marked pattern and a marking of a replicated marked pattern are arranged so as to overlap with each other by arranging the original marked pattern and the replicated marked pattern adjacent to each other in a pattern sequential direction specified by the pattern-sequential-direction specifier;

wherein:

the new pattern includes a plurality of the patterns arranged side by side in an arbitrary direction.

2. The sewing machine according to claim 1, wherein:

the marking displayed relative to the pattern is changed in accordance with the pattern sequential direction; and a marking delete deleting the marking of the original marked pattern and the marking of the replicated marked pattern on the display controller.

3. The sewing machine according to claim 1, wherein the display position of the marking is set with reference to four corners of the pattern.

4. The sewing machine according to claim 1, further comprising a marking-data disposing position specifier changing the display position of the marking, wherein the display positions of the two markings in the pattern sequential direction among the plurality of display positions are moved along the pattern sequential direction.

5. The sewing machine according to claim 1, wherein the marking deleter hides the deletion target marking, thereby deleting the marking on the display.

6. The sewing machine according to claim 1, wherein the pattern and the marking are divided and displayed in different layers on the display.

7. The sewing machine according to claim 1, wherein the sewing machine creates, based on stitchwork data corresponding to the image data of the pattern and the image data of the marking wherein the pattern and the marking form the new pattern, stitchwork data of the new pattern displayed on the display.

8. A computer-readable non-transitory recording medium having stored a pattern-data creating program for a computer, wherein the computer comprises:

a pattern-data memory storing stitchwork data for sewing a pattern, and image data for displaying the pattern on a display; and a marking-data memory storing stitchwork data for sewing a marking to be combined with the pattern, and image data for displaying the marking on the display, and the computer controls the display displaying the pattern and the marking, and wherein the pattern-data creating program causes the computer to execute:

a pattern displaying process of displaying the pattern on the display based on the image data of the pattern;

a pattern-sequential-direction specifying process of specifying the direction in which the plurality of the patterns are arranged in sequence;

a marking disposing position specifying process of specifying a disposing position of the marking relative to the pattern displayed on the display;

a marking displaying process of displaying the marking on the display based on the image data of the marking;

a marked pattern replicating process of replicating an original marked pattern having the marking displayed at a marking disposing position of the pattern; and a marked pattern displaying process of displaying the marked pattern in such a way that the marking of the original marked pattern and a marking of a replicated marked pattern are arranged so as to overlap with each other by arranging the original marked pattern and the replicated marked pattern adjacent to each other in a pattern sequential direction specified by the pattern-sequential-direction specifying process;

wherein:

the pattern includes the plurality of the patterns arranged side by side in an arbitrary direction.

* * * * *